US007241127B2

(12) United States Patent
Hanimann et al.

(10) Patent No.: US 7,241,127 B2
(45) Date of Patent: Jul. 10, 2007

(54) PELLETING PRESS

(75) Inventors: Philipp Hanimann, St. Gallen (CH); Adolph Zellweger, Gossau (CH); Andreas Staub, Stadel (CH)

(73) Assignee: Bühler AG, Uzwil (CH)

( * ) Notice: Subject to any disclaimer, the term of this patent is extended or adjusted under 35 U.S.C. 154(b) by 48 days.

(21) Appl. No.: 10/525,742

(22) PCT Filed: Jul. 21, 2003

(86) PCT No.: PCT/CH03/00488

§ 371 (c)(1),
(2), (4) Date: Sep. 9, 2005

(87) PCT Pub. No.: WO2004/022324

PCT Pub. Date: Mar. 18, 2004

(65) Prior Publication Data

US 2006/0121143 A1 Jun. 8, 2006

(30) Foreign Application Priority Data

Sep. 3, 2002 (DE) ..... 102 41 118

(51) Int. Cl.
*B30B 11/20* (2006.01)

(52) U.S. Cl. ..... 425/331

(58) Field of Classification Search ..... 425/331
See application file for complete search history.

(56) References Cited

U.S. PATENT DOCUMENTS

| | | | | |
|---|---|---|---|---|
| 2,063,404 | A | 12/1936 | Selman | |
| 2,887,718 | A | 5/1959 | Curran et al. | |
| 3,207,091 | A | 9/1965 | Cunningham | |
| 3,534,634 | A | 10/1970 | Kawanami | |
| 3,742,750 | A | 7/1973 | Heesen | |
| 4,226,578 | A | 10/1980 | Gröbli et al. | |
| 4,293,295 | A | 10/1981 | van Deuren | |
| 4,770,621 | A | 9/1988 | Groebli et al. | |
| 4,979,887 | A | 12/1990 | Groebli et al. | |
| 6,244,850 | B1 * | 6/2001 | Van Benthum | 425/331 |

FOREIGN PATENT DOCUMENTS

| | | |
|---|---|---|
| EP | 0 956 943 A1 | 11/1999 |
| FR | 2 591 438 A | 6/1987 |
| GB | 1 599 003 A | 9/1981 |
| NL | 9302236 | 7/1995 |
| WO | WO 91/02644 | 3/1991 |

* cited by examiner

*Primary Examiner*—Robert Davis
*Assistant Examiner*—Marissa W. Chaet
(74) *Attorney, Agent, or Firm*—Finnegan, Henderson, Farabow, Garrett & Dunner, LLP

(57) ABSTRACT

The invention relates to a pelleting press for the production of feed pellets for the like. The aim of the invention is to enable easy and economical separation of the mold in order to change said molds. This is achieved in that guided clamping elements (17) are arranged between the mold (8) and a pressure ring (13) of the mold carrier (11) in such a way that they can be displaced axially (11) so that the mold (8) can be released and clamped by axial displacement by means of a flat contact surface between the screws (18) of the clamping segments (17) and the pressure ring (13).

9 Claims, 5 Drawing Sheets

PELLETING PRESS

Figure 1:
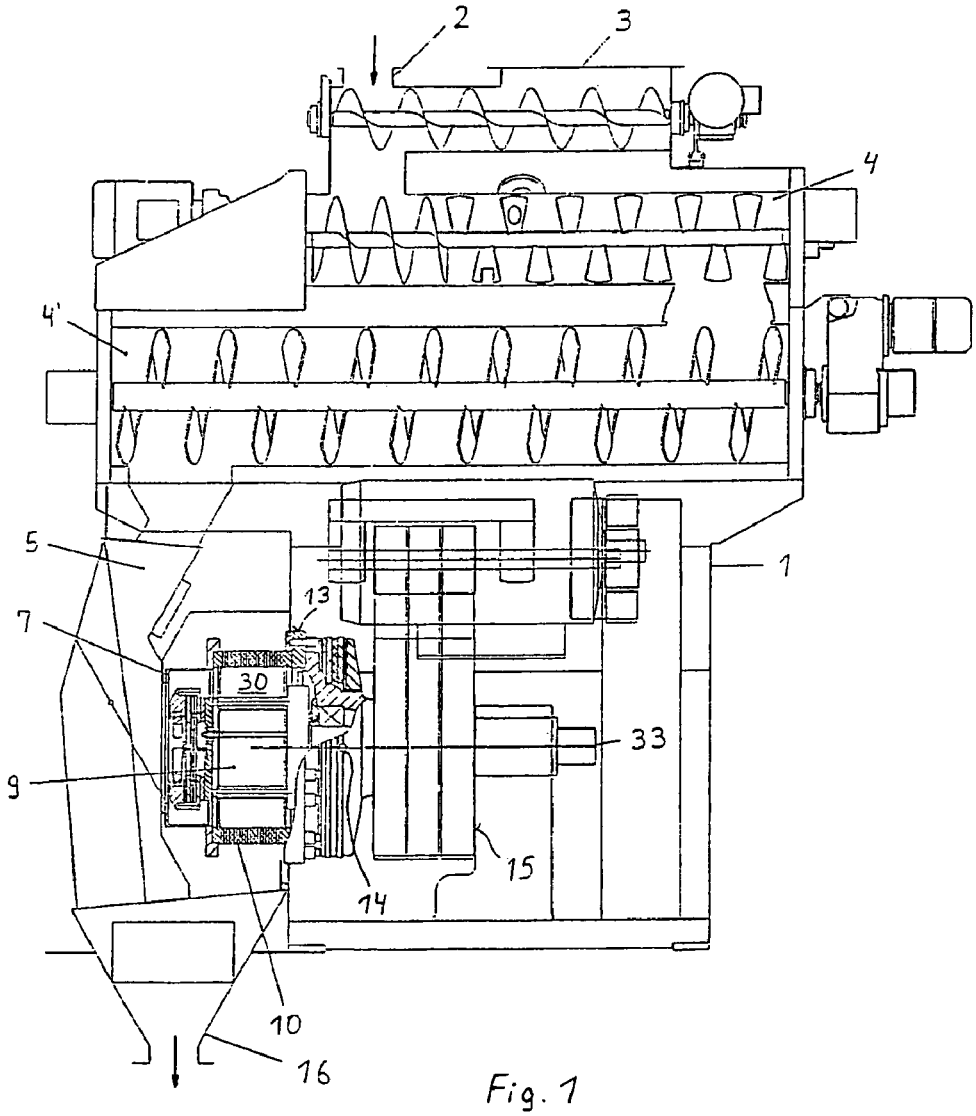

The invention relates to a pellet mill for making feed cubes or the like (e.g., wood cubes too), a clamping device for replacing the dies, and a roller adjuster in such a pellet mill.

For many years, pellet mills, feed pellet mills or pellet presses have enjoyed practical application in the feedstuff and foodstuff industry, as well as in the non-food area. Grainy, powdery and/or pasty materials with the most varied of moisture contents and compositions are pressed.

They have press dies and strippers to fabricate cubes or pellets of the desired size. Such a pellet mill is disclosed, for example, in EP-A-371519. The material to be pressed exits a feed hopper and passes into a conveying and metering device, and from there into a mixer. Both devices are arranged on the top side of the casing of the actual press, wherein the outlet of the mixer conveys in a bent feed box (and in a mold cover), which is located under it but not rigidly connected with the mixer. The material passes from the mold cover into the press die.

One press die is rigidly connected with a rotating press mold holder. Also secured firmly is a pulley carrier with a roller bar fastened thereto. Two rollers are adjustably situated by means of a piston-cylinder unit, so that different gaps and mold pressures can be set on the mold matrix.

Another pelleting press is shown in EP-B-489046, in which the mold and at least one press roller can be driven at variable speeds and as a function of screw clearance.

Various solutions are known to secure the molds in a pellet mill. The initially mentioned fixed arrangement, which involves simply screwing down the mold, is cost-effective, but necessitates a time-consuming mold replacement. However, there are also known solutions for a quick replacement, e.g., according to U.S. Pat. No. 4,979,887, in which short-stroke hydraulic cylinders on the periphery of a wear ring actuate the individual clamping segments. The hydraulic cylinders are connected to an external hydraulic pump for replacing the mold.

Also known according to DE-OS 2108326 is to hold the clamping segments in the position that clamps the matrix using spring elements to improve assembly, wherein adjusting means are provided for detaching the clamping segments against the spring action. The matrix overcomes the spring tensioning forces, making it easy to detach from the column or reattach. Hydraulic winches are used as the adjusting means. A similar solution is shown in DE-OS 2756647, in which a conical ring is used to attach the matrix.

Known in the art is a press roller adjustment device for an extrusion system or pelleting press according to FR-A 2 591 438, in which 3 press rollers are arranged in such a way that they can be adjusted by a shared drive shaft. To this end, the drive shaft has a triangular end piece, whose corners are each hinged to a lever, wherein the other end of the levers is also rotatably hinged to a lever of a press roller.

EP-A-956 943 shows a press roller adjustment device of a pelleting press in which the press rollers can be adjusted via a shared drive shaft, wherein the drive shaft is driven by the belt of a driving mechanism that loops around a pulley arranged on the drive shaft.

The object of the invention is to design a pellet mill in such a way as to enable a simple, and at once sanitary and cost-effective mold replacement. The object is achieved with the features in the claims.

The invention is based upon the knowledge of simultaneously actuating all clamping segments via only a single element, so that the mold can be detached from the pellet mill. This is preferably accomplished using a pressure ring, which can be moved in the mold axis by various force-exerting systems. Such force-exerting systems include:

Back-geared motor with 2 threaded spindles or hydraulic cylinders that act along the axis of the pellet mill Wedge system with hydraulic cylinder transverse to the axis of the pellet mill Bell-crank system actuated by screws, spindles, fluid or cam plate Combination with "lazy tongs"

Sliding rotating element on periphery of pressure ring.

Preferred here are solutions that are economically and easily implemented, and satisfy the application-related sanitation requirements placed on a pellet mill. The subclaims depict preferred embodiments. A combination of a pressure ring and fluidic ring is particularly preferred.

Another object of the invention is to provide a roller adjuster for the press roller to be used in a pellet mill that is simple to assemble and maintain. This object is achieved with the features in the claims.

A simple mechanical-pneumatic system was created, which requires no hydraulics, and can also be manually operated.

The invention will be described in greater detail below in an exemplary embodiment based on a drawing. The drawing shows:

FIG. 1: A pellet mill, partial section

Figure 2:
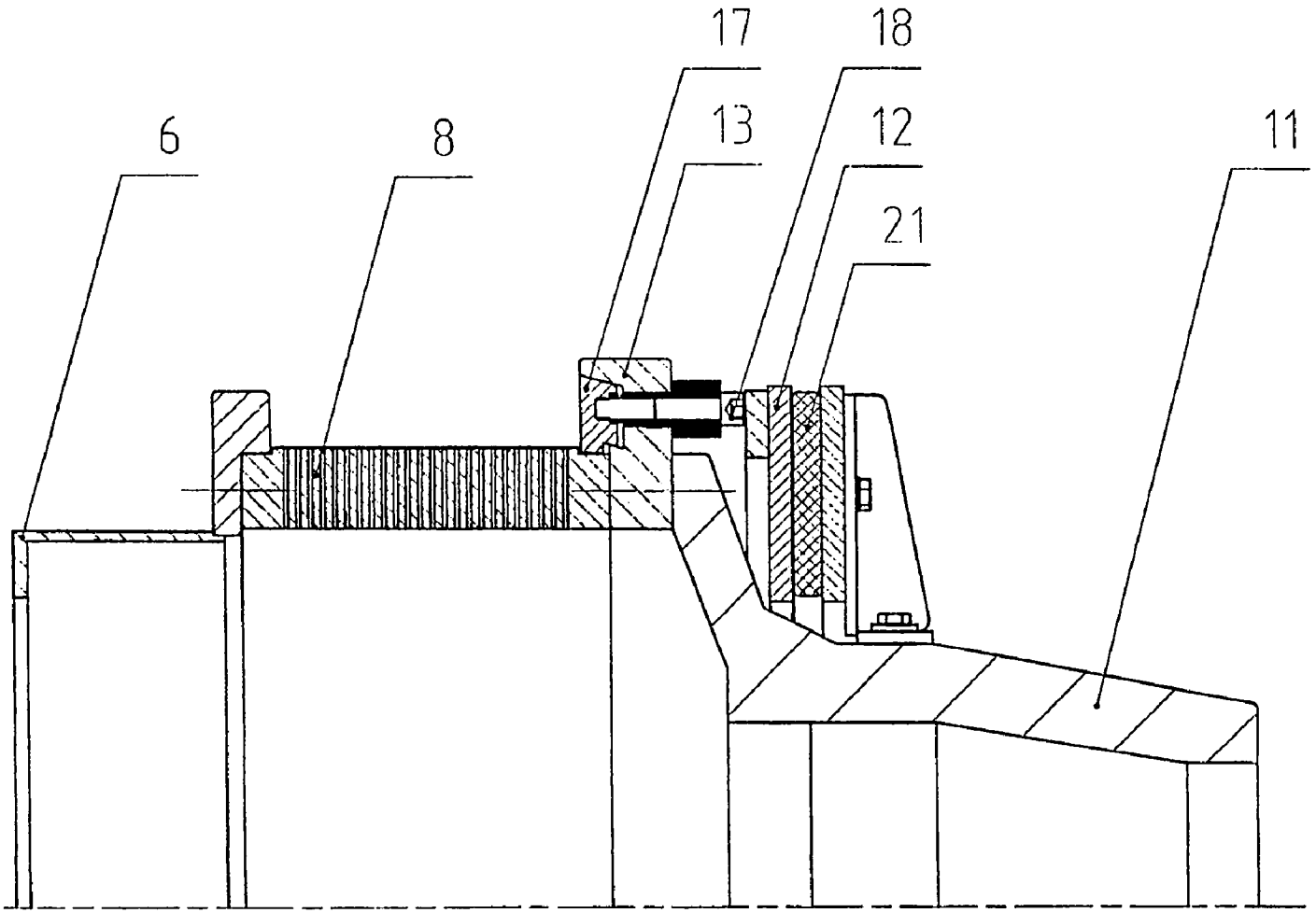

FIG. 2: A form of execution of a clamping device

Figure 3:
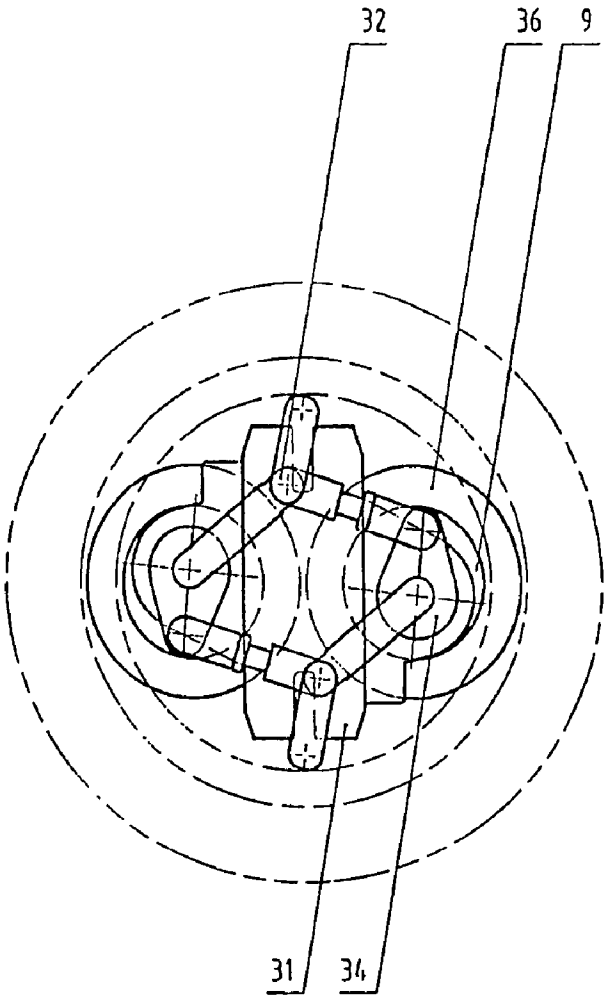

FIG. 3: A form of execution of a roller adjuster

Figure 4:
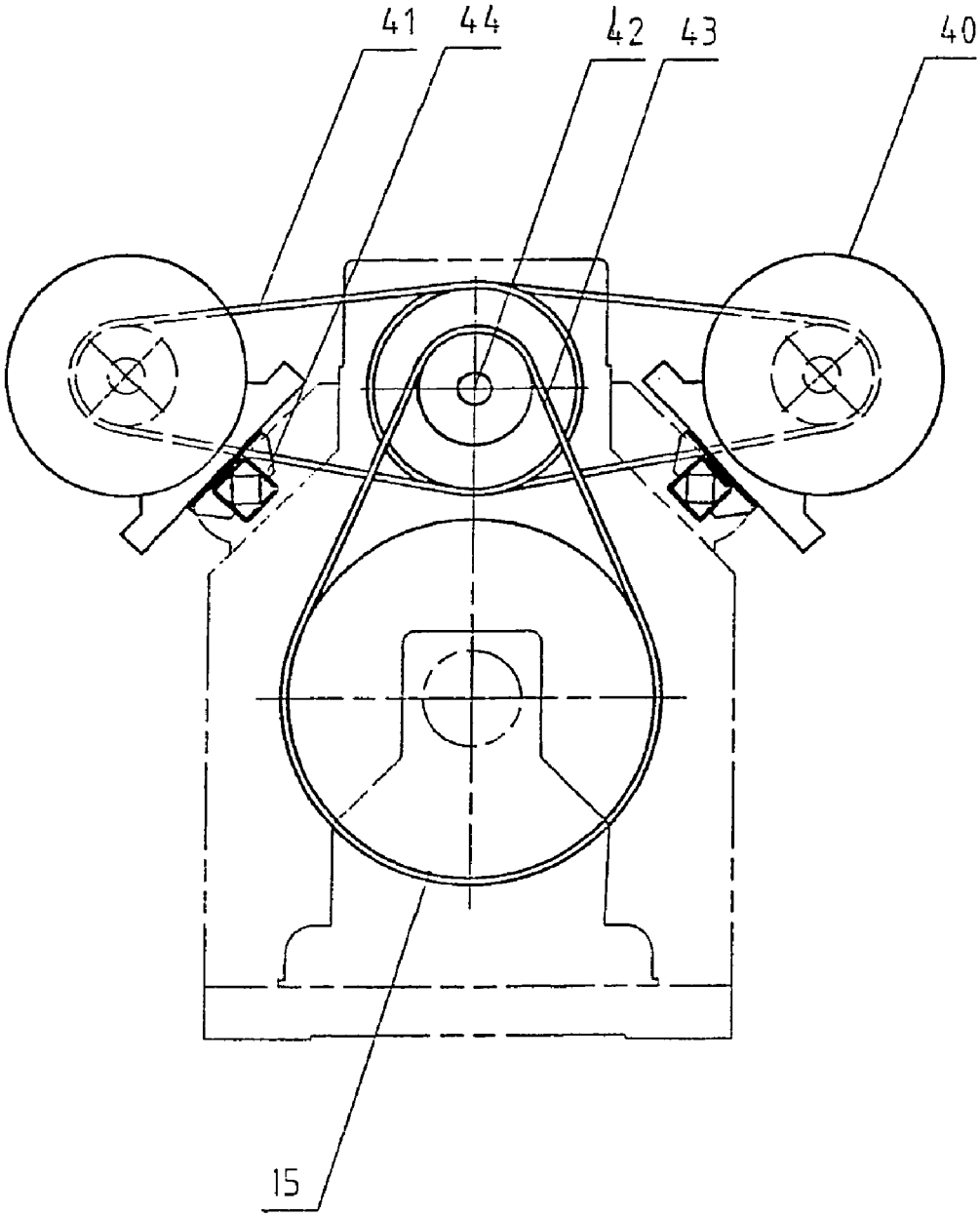

FIG. 4: The drive for a pellet mill

Figure 5:
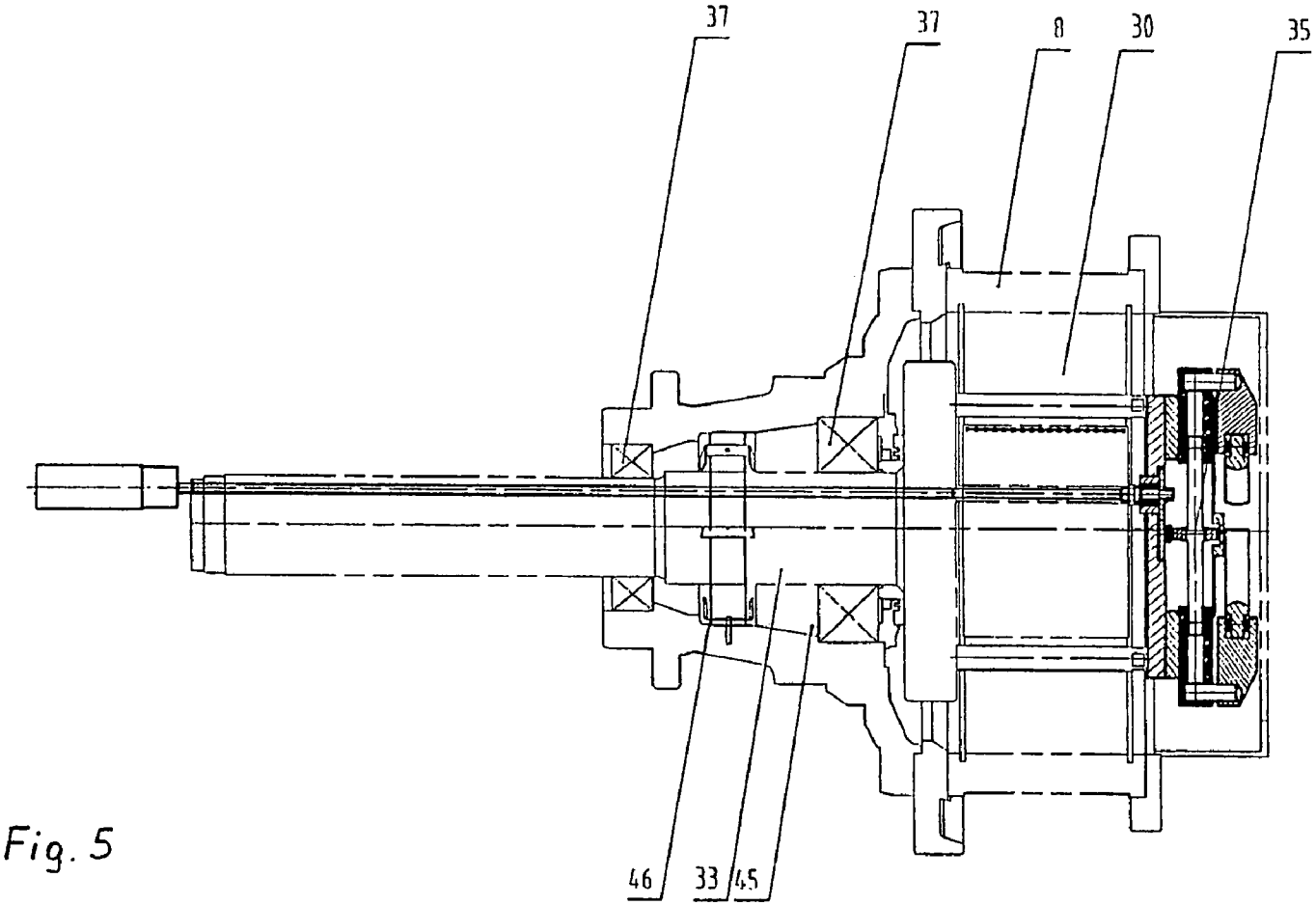

FIG. 5: A design for the main shaft.

In a pellet mill 1, the material to be processed is conveyed via a feed hopper 2 to a metering device, which in turn relays predetermined quantities of the material to a mixer 4. Water vapor and additives can be added to the mixer 4. The material then stays for a specific time in the holding tank 4'. The material mixed and prepared in this way then enters into a channel 5, which routes it to a mold cover 6, from where it traverses stripping shovels 7 and gets into a mold (matrix) 8, where press rollers 9 are used to press it through radial boreholes 10 of this mold 8. The pellets are removed via a channel 16.

The mold 8 is held by a ring 12 secured to a rotatable mold carrier 11, and by a pressure ring 13. If needed, the mold carrier 11 can be manually rotated by inserting levers in holes 14. Drive normally takes place via a driving wheel 15, however.

Distributed on the periphery of the mold 8 between the pressure ring 13 and mold 8 are clamping segments 17, which run in guide elements and are conical on one side. In this case, 3-4 moveable clamping segments can already be sufficient. The guide elements consist of screws 18 and spring packets that pass through the pressure ring 13 and are screwed with the clamping segments 17. The pressure ring 13 is used to exert a pressure on the screws 18.

An anti-twisting safeguard is provided for the mold 8.

As a result of the flat contact surface between the screws 18 of the clamping segments 17 and pressure ring 13, the clamping segments 17 are here pressed onto the mold 8, thereby centering and securely clamping it.

Situated behind the pressure ring 13 in the direction of the ring 12 is a fluidic element in the form of an air cushion 21, which allows the pressure ring 13 to move axially after/via filling. Such a repulsion mechanism is completely symmetrical in design, thus resulting in a simple structure and avoiding unbalances.

The sequence of movements can also take place in the opposite direction.

The advantages reaped not just from this embodiment of the invention include improved sanitation and a faster and more efficient mold replacement. In addition, the number of moveable elements is reduced.

The press rollers 9 are adjusted by a mechanical arrangement in the processing space 30, which can be accessed after removing a cover, and can also be manually operated. The press roller adjusting arrangement consists of a base 31, which is secured to a main shaft 33, and has hinged centrally to it two pairs of lever arms 32 provided with a yoke. The opposing ends of the lever arms 32 are hinged to cams 34 of the press rollers 9. A spindle 35 can be used to guide and shift the lever pairs, and thereby adjust the press rollers 9 via the cams 34. The adjusting mechanism is only exposed to a slight load, and the possible large adjustment paths necessitate fewer readjustments of the cams 34. A measuring system is provided to limit the forces.

The drive of the roller adjuster is situated outside the product area, and acts on the adjusting mechanism via the main shaft 33.

The selected roller adjuster can be used to realize high transmission ratios, which in turn requires only slight drive outputs, e.g., a transmission ratio of up to 1:20000 and a drive output of approx. 100 W.

The pelleting press is provided with a lubricating device that no longer requires a central lubricating system (electrical grease pump), but also makes do without the daily manual lubrication of contemporary, manually lubricated pelleting presses.

On the one hand, the press rollers 9 are equipped with commercially available bearings with lifetime lubrication. These bearings are lubricated again when the roller flange 36 has to be replaced for reasons of wear at the earliest. On the other hand, the bearings 37 of the roller retaining shaft (main shaft 33) are equipped with a grease depot 45, so that the grease flows very slowly through the bearings, and enables long lubricating intervals that roughly correspond to the life of the roller flange 36, so that it can be performed during the course of regular maintenance work.

In one variant, the grease can be distributed up to the roller adjuster. It is relayed to the depot and wherever else required by means of a tub situated in the main shaft 33.

The driving wheel 15 arranged on the main shaft 33 is driven by pulleys from two higher speed motors 40 arranged parallel to the main shaft 33.

An overdrive 41 is used to initially drive a vertical shaft 42, and overdrive to the main shaft 33 takes place via V-belts (poly-V) 43. At least two V-belts 43 are preferably provided.

The motors 40 can each be adjusted slip-free by means of rubber spring elements (44). These rubber spring elements act to attenuate and separate the motors from the base frame of the pelleting press in terms of mechanical oscillations. The belts (41) are pre-stressed with these rubber spring elements, and retain a constant pre-stressing force, even without subsequent stressing, even given an expanding belt length.

Therefore achieved is a simple, two-stage drive, with which different mold speeds can be set. An output speed of approx. 1,500 $R^{-1}$ can be reduced to approx. 200-250 $R^{-1}$ of the mold without any problem. Speeds can be effectively varied and adjusted to the respective product by simply changing the disks on the vertical shaft 42.

REFERENCE NUMBERS

1 Pellet mill
2 Feed hopper
3 Metering device
4 Mixer
4' Holding tank
5 Channel
6 Mold cover
7 Stripping shovel
8 Mold
9 Press roller
10 Borehole
11 Mold carrier
12 Ring
13 Pressure ring
14 Hole
15 Driving wheel
16 Channel
17 Clamping segment
18 Screw
21 Element/air cushion
30 Processing space
31 Base
32 Lever arm
33 Main shaft
34 Cam
35 Spindle
36 Roller flange
37 Main shaft bearing
40 Motor
41 Overdrive
42 Vertical shaft
43 V-belt
44 Rubber spring element
45 Grease depot
46 Distributing element

The invention claimed is:

1. A pellet mill with a hollow cylindrical mold, whose inner circumferential surface accommodates at least one adjustable press roller, characterized in that a base is secured to a main shaft of the mold in such a way that it can rotate with the main shaft, and has hinged centrally to it two pairs of lever arms provided with a yoke, and their opposing ends are hinged or pivoted to cams of the press rollers, wherein the lever pairs are each connected with an element that is also hinged to the cams and can shift on the base.

2. The pellet mill according to claim 1, characterized in that the elements can be shifted by means of a spindle.

3. The pellet mill according to claim 1, characterized in that at least one main bearing of a roller retaining shaft is equipped with a grease depot.

4. The pellet mill according to claim 1, characterized in that claiming segments are arranged between the mold and a pressure ring of the mold carrier, and that a flexible, fluidic element is arranged behind the pressure ring in the gap to a ring.

5. The pellet mill according to claim 4, characterized in that a distributing element is provided on the mold carrier.

6. The pellet mill according to claim 1, characterized in that the fluidic element is an air cushion.

7. The pellet mill according to claim 1, characterized in that a driving wheel of the driven main shaft is connected by a V-belt with a parallel arranged vertical shaft, which in turn is connected by another V-belt with a drive consisting of two parallel arranged motors on either side of the main shaft.

8. The pellet mill according to claim 7, characterized in that the belt drive encompasses at least one V-belt.

9. The pellet mill according to claim 7, characterized in that the motors are adjustably arranged.

* * * * *

UNITED STATES PATENT AND TRADEMARK OFFICE

CERTIFICATE OF CORRECTION

PATENT NO. : 7,241,127 B2
APPLICATION NO. : 10/525742
DATED : June 10, 2007
INVENTOR(S) : Philipp Hanimann et al.

It is certified that error appears in the above-identified patent and that said Letters Patent is hereby corrected as shown below:

On the title page, item (57), line 2, “for” should read --or--.

Signed and Sealed this

Sixteenth Day of October, 2007

JON W. DUDAS
*Director of the United States Patent and Trademark Office*

UNITED STATES PATENT AND TRADEMARK OFFICE

CERTIFICATE OF CORRECTION

PATENT NO. : 7,241,127 B2
APPLICATION NO. : 10/525742
DATED : July 10, 2007
INVENTOR(S) : Philipp Hanimann et al.

It is certified that error appears in the above-identified patent and that said Letters Patent is hereby corrected as shown below:

On the title page, item (57), line 2, “for” should read --or--.

This certificate supersedes Certificate of Correction issued October 16, 2007.

Signed and Sealed this

Thirteenth Day of November, 2007

JON W. DUDAS
*Director of the United States Patent and Trademark Office*